US009964875B2

(12) United States Patent
Yoon et al.

(10) Patent No.: US 9,964,875 B2
(45) Date of Patent: May 8, 2018

(54) TONER FOR DEVELOPING ELECTROSTATIC LATENT IMAGE

(71) Applicant: S-PRINTING SOLUTION CO., LTD., Suwon-si, Gyeonggi-do (KR)

(72) Inventors: Se-young Yoon, Hwaseong-si (KR); Hae-ree Joo, Seoul (KR); Sung-jun Cho, Gumi-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days. days.

(21) Appl. No.: 15/317,014

(22) PCT Filed: Jul. 14, 2015

(86) PCT No.: PCT/KR2015/007286
§ 371 (c)(1),
(2) Date: Dec. 7, 2016

(87) PCT Pub. No.: WO2016/010335
PCT Pub. Date: Jan. 21, 2016

(65) Prior Publication Data

US 2017/0131648 A1 May 11, 2017

(30) Foreign Application Priority Data

Jul. 15, 2014 (KR) ..... 10-2014-0088840

(51) Int. Cl.
*G03G 9/08* (2006.01)
*G03G 9/107* (2006.01)
(Continued)

(52) U.S. Cl.
CPC ..... *G03G 9/0825* (2013.01); *G03G 9/0819* (2013.01); *G03G 9/08755* (2013.01); *G03G 9/0904* (2013.01); *G03G 9/1075* (2013.01)

(58) Field of Classification Search
CPC .. G03G 9/0825; G03G 9/1075; G03G 9/0819; G03G 9/08755; G03G 9/0904
See application file for complete search history.

(56) References Cited

U.S. PATENT DOCUMENTS 5,402,215 A * 3/1995 Yamaji ..... G03G 15/0921 399/272
8,592,116 B2 11/2013 Pang et al.
(Continued)

FOREIGN PATENT DOCUMENTS

JP 2008-170489 7/2008
JP 2012-83661 4/2012
(Continued)

OTHER PUBLICATIONS

International Search Report dated Sep. 22, 2015 in corresponding International Application No. PCT/KR2015/007286.
(Continued)

*Primary Examiner* — Thorl Chea
(74) *Attorney, Agent, or Firm* — Staas & Halsey LLP

(57) ABSTRACT

Disclosed is a toner for developing an electrostatic latent image, the toner comprising a plurality of toner particles, each toner particle includes: a core particle that contains a binding resin, a coloring agent, and a releasing agent; and an external additive attached to the surface of the core particle, wherein the toner has two endothermic peaks in a heat curve, which is obtained at the time of the secondary temperature rise in differential scanning calorimetry of the toner, and a stepped endothermic curve; and first and second melting temperatures, which are determined to be the locations of vertices of the two endothermic peaks, a glass transition temperature, which is determined to be the midpoint of a linear portion of the stepped endothermic curve, and first and second heat of melting, which are determined to be the areas of the two endothermic peaks, satisfy the condition set forth herein.

8 Claims, 2 Drawing Sheets

(51) Int. Cl.
*G03G 9/087* (2006.01)
*G03G 9/09* (2006.01)

(56) References Cited

U.S. PATENT DOCUMENTS

| | | | | |
|---|---|---|---|---|
| 8,906,588 | B2 | 12/2014 | Shinya et al. | |
| 2006/0210902 | A1 | 9/2006 | Nakamura | |
| 2008/0160443 | A1 | 7/2008 | Yuasa et al. | |
| 2009/0142094 | A1 | 6/2009 | Sawada et al. | |
| 2011/0183252 | A1* | 7/2011 | Pang | G03G 9/0819 430/109.4 |
| 2012/0214096 | A1 | 8/2012 | Pang et al. | |
| 2012/0237864 | A1* | 9/2012 | Saito | G03G 9/09725 430/105 |
| 2014/0356774 | A1 | 12/2014 | Miki et al. | |

FOREIGN PATENT DOCUMENTS

| | | |
|---|---|---|
| JP | 2014-85443 | 5/2014 |
| KR | 10-2012-0095152 | 8/2012 |
| KR | 10-2014-0059849 | 5/2014 |

OTHER PUBLICATIONS

International Search Report dated Sep. 22, 2015 in corresponding International Patent Application No. PCT/KR2015/007286.

* cited by examiner

TONER FOR DEVELOPING ELECTROSTATIC LATENT IMAGE

CROSS-REFERENCE TO RELATED APPLICATION

This application is a U.S. national stage application, which claims the benefit under 35 USC § 371 of PCT International Patent Application No. PCT/KR2015/007286 filed Jul. 14, 2015 which claims foreign priority benefit under 35 USC § 119 of Korean Patent Application No. 10-2014-0088840, filed on Jul. 15, 2014, the entire contents of which are incorporated herein by reference.

TECHNICAL FIELD

The present invention relates to an electrophotographic developer, and more particularly, to a developer to develop electrostatic latent images.

BACKGROUND ART

Developers used in electrophotographic imaging apparatuses such as printers and copy machines may be classified into one-component developers consisting exclusively of toner and two-component developers including toner and a magnetic carrier. In a system using a one-component or two-component developer (hereinafter, referred to as one-component development system or two-component development system), toner is charged with a constant amount of charges and then supplied to a photoreceptor having an electrostatic latent image thereon to form a toner image. This toner image is then transferred onto paper by a transfer member, and fixed thereto as a final image by heat and pressure.

A two-component development system may include a mixture of toner and a magnetic carrier in a ratio in a developing unit. In the two-component development system, the toner may be charged by friction with the magnetic carrier. For a long lifespan of such two-component development systems, it is important that the initial characteristics of the toner and the magnetic carrier can be maintained for the long period of frictional charging till the end stage of the lifespan, since it is crucial to maintain the toner charge amount constant during an electrophotographic process in terms of image concentration and quality control. In general, the longer the period of use of toner, the smaller the toner charge amount. This is due to state change of the toner and magnetic carrier for the following expected causes.

A) Change in Toner

The main cause of change in toner charge amount may be a behavior of the external additive. The friction between toner particles and the magnetic carrier by stirring for a long time may cause the external additive on the toner surface to become buried inside the toner particles. The external additive may also be separated from the toner particles by friction or shear force. Such a change in the state or amount of the external additive may cause change in the toner charge amount.

B) Change in Magnetic Carrier

Friction between the magnetic carrier and the toner particles for a long time may reduce the thickness of a resin layer coated on a surface of the magnetic carrier or may cause separation of the resin layer from the surface of the magnetic carrier. When the external additive separated from the toner particles adhere to the surface of the magnetic carrier, the toner may not be effectively charged. Furthermore, an organic substance such as a releasing agent from the surface of the toner particles may contaminate the surface of the magnetic carrier.

Therefore, to maintain the toner charge amount constant, it is important to design an effective external additive and to reduce surface contamination of the magnetic carrier.

JP 2008-170489 discloses a toner for developing electrostatic latent images with good fixing characteristics, fluidity, and durability, wherein, in differential scanning calorimetric (DSC) thermograms of two types of waxes (wax A and wax B) which are a component of the toner particle, the onset temperatures O(A) and O(B) of wax A and wax B and the endothermic peak temperatures P(A) and P(B) thereof satisfy the following conditions: O(A)<O(B) and P(B)≤P(A).

However, the control of such parameters is not enough to provide a two-component developer that may effectively inhibit contamination of the magnetic carrier even in a printing process performed for a long time and consequentially suppress image defects caused by a reduced charge amount of the toner.

DETAILED DESCRIPTION OF THE INVENTION

Technical Problem

The present invention provides a two-component developer that may suppress an image defect resulting from a reduced charge amount of toner caused due to contamination of a magnetic carrier in a two-component development system, even in a printing process performed for a long time.

Technical Solution

According to an aspect of the present invention, there is provided a toner for developing electrostatic latent images, including a plurality of toner particles, wherein each toner particle includes:

a core particle comprising a binder resin, a colorant, and a releasing agent; and an external additive adhering to a surface of the core particle, and wherein the toner exhibits two endothermic peaks and a stepped endothermic curve in a thermogram which is obtained from a secondary temperature rise in differential scanning calorimetry (DSC), wherein first and second melting temperatures (Tm1 and Tm2) are determined as the temperatures at the vertices of the two endothermic peaks, a glass transition temperature (Tg) is determined as a temperature at the midpoint of a linear region of the stepped endothermic curve, and first and second heats of melting (ΔH1 and ΔH2) are determined as the areas of the two endothermic peaks respectively, and wherein Tm1, Tm2, Tg, ΔH1 and ΔH2 satisfy the following conditions:

$$55^\circ\ C. \leq Tg \leq 65^\circ\ C. \quad (1)$$

$$Tg \leq Tm1 \leq 75^\circ\ C. \quad (2)$$

$$Tm1 \leq Tm2 \leq 90^\circ\ C. \quad (3)$$

$$0.5 < \Delta H1/\Delta H2 < 1.5 \quad (4)$$

In some embodiments, the first heat of melting ΔH1 and the second heat of melting ΔH2 may satisfy the following conditions:

$$0.1 \leq \Delta H1 \leq 0.9 \text{ J/g} \quad (5)$$

$$0.1 \leq \Delta H2 \leq 0.9 \text{ J/g} \quad (6)$$

In some embodiments, the toner may further include magnetic carrier particles, wherein an average particle diameter (D50t) of the plurality of toner particles and an average particle diameter (D50c) of the magnetic carrier particles may satisfy the following condition:

$$0.08 \leq D50t/D50c \leq 0.25 \quad (7)$$

wherein the average particle diameter (D50t) refers to a particle diameter at 50% of cumulative weight in a cumulative particle diameter distribution curve of the toner particles, and the average particle diameter (D50c) of the magnetic carrier particles refers to a particle diameter at 50% of cumulative weight in a cumulative particle diameter distribution of the magnetic carrier particles.

In some embodiments, the external additive may include a combination of silica particles, titanium oxide particles, and iron oxide particles.

In some embodiments, [Si], [Ti], and [Fe] as the intensities of silicon, titanium, and iron measured by X-ray fluorescence spectrometry of the toner may satisfy the following conditions:

$$0.005 \leq [Si] \leq 0.2 \quad (8)$$

$$1 \leq [Ti] \leq 30 \quad (9)$$

$$2 \leq [Fe] \leq 200 \quad (10)$$

In some embodiments, the releasing agent may be a combination of a carnauba-based wax and a fatty acid ester-based wax.

In some embodiments, the binder resin may be a polyester resin.

In some embodiments, the toner may be used in a non-magnetic two-component development process.

Advantageous Effects

As described above, according to the one or more embodiments, a toner for developing electrostatic latent images may effectively suppress surface contamination of a magnetic carrier. Accordingly, a toner according to any of the embodiments may effectively suppress a charge amount reduction even when used in printing for a long time in a two-component development system. When used in a two-component development system, a toner according to any of the embodiments may exhibit improved transfer characteristics even in printing for a long time, and thus, effectively preventing an electrophotographic imaging apparatus from being contaminated by scattering of toner particles which are not adhered to a magnetic roller, and also effectively suppressing an image defect, such as photoreceptor background contamination, which otherwise may be caused by a charge amount reduction of toner.

MODE OF THE INVENTION

Figure 1:
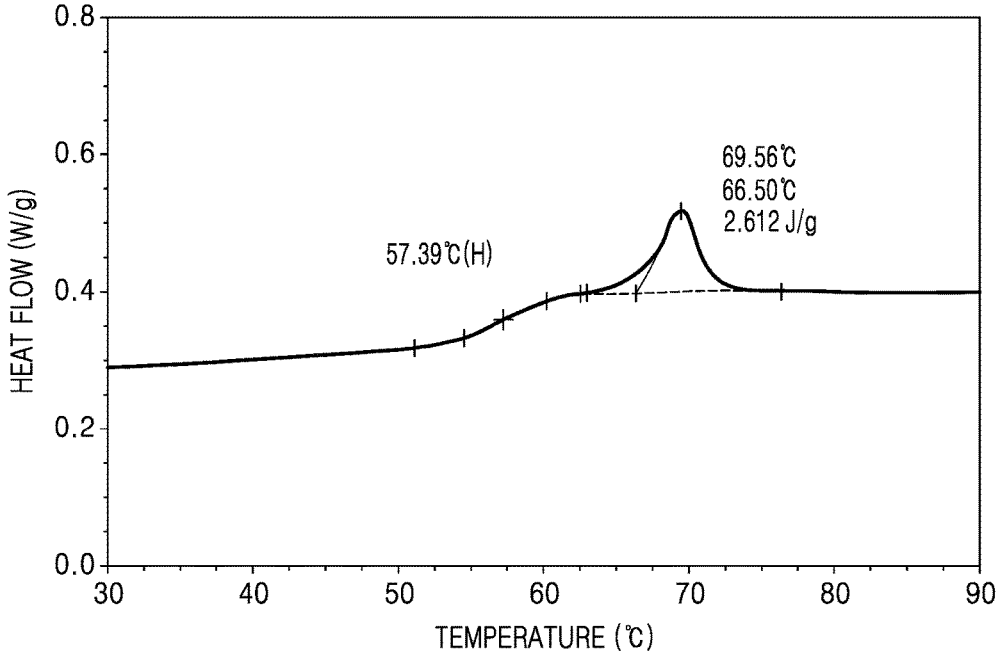
FIG. 1 is a differential scanning calorimetry (DSC) endothermic thermogram of a conventional toner using a polyethylene wax.

Hereinafter, embodiments of a toner for developing electrostatic latent images will be described in greater detail.

According to an aspect of the present disclosure, a toner for developing electrostatic latent images includes a plurality of toner particles, wherein each toner particle includes a core particle, and an external additive adhering to a surface of the core particle.

The core particle may include a binder resin, a colorant, and a releasing agent.

For example, the binder resin may include, but is not limited thereto, a styrene resin, an acryl resin, a vinyl or polyolefin resin, a polyether polyol resin, a phenol resin, a silicon resin, a polyester resin, an epoxy resin, a polyamide resin, a polyurethane resin, a polybutadiene resin, or a mixture thereof.

For example, the styrene resin may include: polystyrene; a homopolymer of styrene derivatives, such as poly-p-chlorostyrene or polyvinyltoluene; a styrene-based copolymer, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-α-chloromethacrylic acid methyl copolymer, a styrene-acrylonitrile copolymer, a styrene-vinylmethylether copolymer, a styrene-vinylethylether copolymer, a styrene-vinylmethylketone copolymer, a styrene-butadiene copolymer, a styrene-isoprene copolymer, or a styrene-acrylonitrile-indene copolymer; or a mixture thereof.

For example, the acryl resin may include an acrylic acid polymer, a methacrylic acid polymer, a methacrylic acid methylester polymer, an α-chloromethacrylic acid methylester polymer, or a mixture thereof.

For example, the vinyl or polyolefin resin may include polyvinyl chloride, polyethylene, polypropylene, polyacrylonitrile, polyvinyl acetate, or a mixture thereof.

The polyester resin may be prepared by a reaction, such as direct esterification or transesterification, of an aliphatic, alicyclic, or aromatic polyvalent carboxylic acid or an alkyl ester thereof with a polyvalent alcohol. The polyvalent carboxylic acid may include phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and/or cyclohexane dicarboxylic acid. In addition to these dicarboxylic acids, polyvalent carboxylic acids, for example, trimellitic acid, pyromellitic acid, naphthalene tricarboxylic acid, naphthalene tetracarboxylic acid, pyrene tricarboxylic acid, pyrene tetracarboxylic acid, and the like, may be used. Derivatives of these carboxylic acids, such as an acid anhydride, an acid chloride, or an ester of carboxylic group, may also be used. For example, terephthalic acid or low esters thereof, diphenylacetic acid, cyclohexane dicarboxylic acid, or the like may be used. Lower esters refer to esters of C1-C8 aliphatic alcohols. Examples of the polyvalent alcohol may include: aliphatic diols, such as ethylene glycol, diethylene glycol, triethylene glycol, propylene glycol, butanediol, hexanediol, neopentyl glycol, and glycerine; alicyclic diols, such as cyclohexane diol, cyclohexane dimethanol, and hydrogenated bisphenol A; and aromatic diols, such as an ethylene oxide adduct of bisphenol A, a propylene oxide adduct of bisphenol A, and the like. One or at least two of these polyvalent alcohols may be used. In some embodiments, the polyvalent alcohol may be an aromatic diol or an alicyclic diol. For example, the polyvalent alcohol may be an aromatic diol. To form a cross-linked structure or branched structure for good fixing characteristics, such a diol may be used together with a trivalent or greater polyvalent alcohol (glycerine, trimethylolpropane, or pentaerythritol).

The binder resin may have a number average molecular weight of, for example, about 700 to about 1,000,000 g/mol, and in some embodiments, a number average molecular weight of about 10,000 to about 500,000 g/mol. In some embodiments, the binder resin used in the present invention may be a combination of a high-molecular weight binder resin and a low-molecular weight binder resin in an appropriate ratio. The high-molecular weight binder resin may have a number average molecular weight of, for example, about 100,000 to about 500,000 g/mol. The low-molecular weight binder resin may have a number average molecular weight of, for example, about 1,000 to less than 100,000 g/mol. These two binder resins having different molecular weights may independently exhibit their own function. The low-molecular weight binder resin may contribute to fixing characteristics and gloss due to less molecular chain entanglements. On the other hand, the high-molecular weight binder resin may have increased molecular chain entanglements and thus may maintain elasticity to a certain extent at a high temperature, contributing to anti-hot offset characteristic. In view of fixing characteristics and preservability at high temperature, a glass transition temperature Tg of these binder resins may be controlled to satisfy the following condition: 55° C.≤Tg≤65° C., wherein Tg denotes a glass transition temperature determined as a temperature at the midpoint of a linear portion of a stepped endothermic curve resulting from a secondary temperature rise in differential scanning calorimetry (DSC) of the toner. The glass transition temperature Tg is a measured temperature obtained under certain conditions, as described later.

The colorant may be, for example, a black colorant, a yellow colorant, a magenta colorant, a cyan colorant, or a combination thereof.

For example, the black colorant may be carbon black, aniline black, or a mixture thereof.

For example, the yellow colorant may be a condensed nitrogen compound, an isoindolelinone compound, an anthraquinone compound, an azo metal complex, an arylimide compound, or a mixture thereof. For example, the yellow colorant may be a "C.I. pigment yellow" 12, 13, 14, 17, 62, 74, 83, 93, 94, 95, 109, 110, 111, 128, 129, 147, 168, or 180, where "C.I." indicates Color Index.

For example, the magenta colorant may be a condensed nitrogen compound, an anthraquine compound, a quinacridone compound, a base dye lake compound, a naphthol compound, a benzo imidazole compound, a thioindigo compound, a perylene compound, or a mixture thereof. For example, the magenta colorant may be a "C.I. pigment red" 2, 3, 5, 6, 7, 23, 48:2, 48:3, 48:4, 57:1, 81:1, 122, 144, 146, 166, 169, 177, 184, 185, 202, 206, 220, 221, or 254.

For example, the cyan colorant may be a copper phthalocyanine compound or a derivative thereof, an anthraquinone compound, a base dye lake compound, or a mixture thereof. For example, the cyan colorant may be a "C.I. pigment blue" 1, 7, 15, 15:1, 15:2, 15:3, 15:4, 60, 62, or 66.

An amount of the colorant in the core particles may be, for example, from about 0.1 parts by weight to about 20 parts by weight, and in some embodiments, from about 2 parts by weight to about 10 parts by weight, each based on 100 parts by weight of the binder resin.

The releasing agent may be, for example, a polyethylene-based wax, a polypropylene-based wax, a silicon-based wax, a paraffin-based wax, an ester-based wax, a carnauba-based wax, a metallocene-based wax, or a mixture thereof. For example, the releasing agent may be a combination of carnauba-based wax and fatty acid ester-based wax.

For example, the releasing agent may have a melting point of from about 50□ to about 150° C. An amount of the releasing agent in the core particles may be from about 1 part by weight to about 20 parts by weight, and in some embodiments, from about 1 part by weight to about 10 parts by weight, each based on 100 parts by weight of the binder resin. The releasing agent may prevent toner particles from adhering to a heating roller of a fusing unit. The larger the amount of the releasing agent used becomes, the wider an anti-offset range may become or the better the fixing characteristics may become. However, when a larger amount of the releasing agent is exposed to the surfaces of the toner particles, the releasing agent may contaminate the surface of the magnetic carrier and consequentially lower charging characteristics of the magnetic carrier and the toner particles. When using toner including an excess of the releasing agent, the excess of the releasing agent may cause filming on a surface of a photoreceptor.

To address these drawbacks, as a result of repeated research, the inventors of the present disclosure have found that using a small amount of a certain releasing agent having a good releasability effectively reduces the surface contamination of the magnetic carrier and maintains the amount of charges even after use of a two-component developer for a long period. This will be described in greater detail below.

Figure 2:
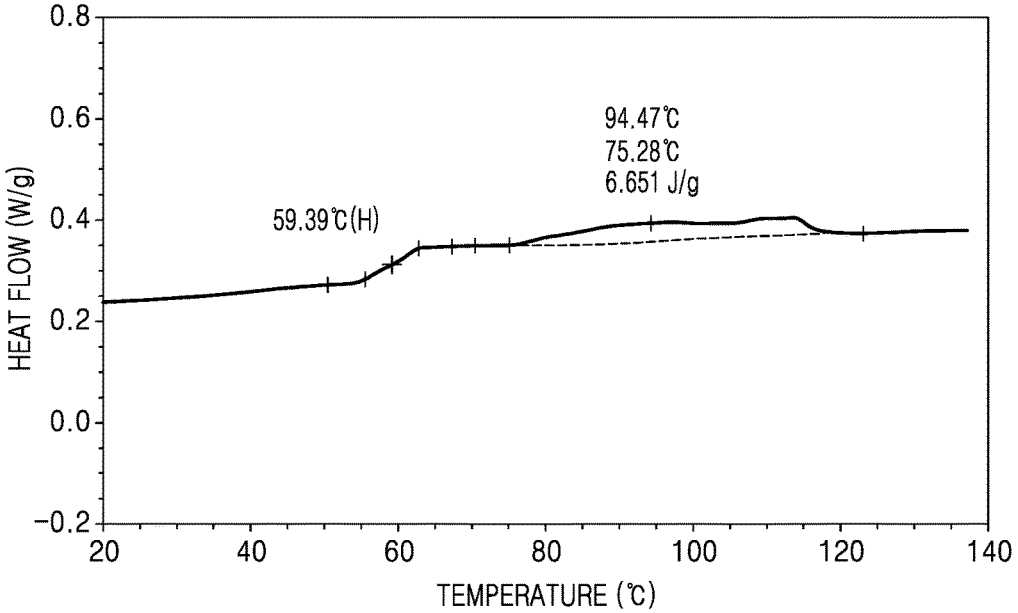
FIG. 2 is a DSC endothermic thermogram of a conventional toner using polypropylene wax.

FIG. 1 and FIG. 2 are endothermic DSC thermograms of a conventional toner using a polyethylene-based wax and a conventional toner using a polypropylene-based wax, respectively. When the amount of wax used is increased in order to improve high-temperature anti-offset (hot anti-offset) characteristics, the area of an endothermic peak may be increased. On the other hand, when the amount of wax used is reduced, the area of an endothermic peak may be reduced. In the case of FIG. 1, the polyethylene wax has a melting point (Tm) of about 70° C. and a heat of melting (ΔH) of about 2.6 J/g, which is defined as the area of the endothermic peak. In the case of FIG. 2, the polypropylene wax has a melting point of about 95° C. and a heat of melting (ΔH) of about 6.7 J/g. A toner having such a high heat of melting (ΔH) has a relatively high wax content, and thus separation of an external additive from the core particle and thereby, contamination of the magnetic carrier by the wax of the toner may more likely occur when it is closer to the end of the toner lifespan.

The inventors of the present invention have found that using a combination of two different waxes satisfying the following conditions as a releasing agent may be effective to maintain good high-temperature anti-offset characteristics and low-temperature anti-offset characteristics of the toner and to reduce contamination of the magnetic carrier surface, wherein the first and second heats of melting ΔH1 and ΔH2 are determined as the area of an endothermic peak resulting from melting of the releasing agent in a secondary temperature rise of a DSC thermogram of the toner:

$$Tg \leq Tm1 \leq 75° \text{ C.} \quad (2)$$

$$Tm1 \leq Tm2 \leq 90° \text{ C.} \quad (3)$$

$$0.5 < \Delta H1/\Delta H2 < 1.5 \quad (4)$$

wherein Tm1 and Tm2 indicate melting temperatures of the two different waxes, respectively, which are determined as the temperatures at the vertices of two endothermic peaks in a heat curve resulting from a secondary temperature rise in a DSC thermogram of the toner; and ΔH1 and ΔH2 indicate first and second heats of melting of the two different waxes, respectively, which are determined as the areas of the two endothermic peaks, respectively. The first heat of melting (ΔH1) is of a wax having the melting temperature (Tm1), and the second heat of malting (ΔH2) is of a wax having the melting temperature (Tm2). For example a difference between the melting temperatures (Tm1 and Tm2) may be 15° C. or less.

The inventors of the present invention have found that controlling the amounts of the waxes in the toner so as to satisfy the following conditions of the first and second heats of melting (ΔH1 and ΔH2) may be more effective to reduce the surface contamination of the magnetic carrier and to maintain a good high-temperature anti-offset characteristic and a good low-temperature anti-offset characteristic of the toner:

$$0.1 \leq \Delta H1 \leq 0.9 \text{ J/g}$$

$$0.1 \leq \Delta H2 \leq 0.9 \text{ J/g}$$

In particular, the inventors of the present invention have found that controlling the first and second heats of melting (ΔH1 and ΔH2) to satisfy the following conditions may be more effective to provide toner having an improved releasability with a small amount of wax and to maintain a good high-temperature anti-offset characteristic and a good low-temperature anti-offset characteristic:

$$0.1 \leq \Delta H1 \leq 0.7 \text{ J/g}$$

$$0.1 \leq \Delta H2 \leq 0.7 \text{ J/g}$$

Table 1 shows the results of measurements of carbon content in the surface of a magnetic carrier of each of the two-component toners including different amounts of a wax when measured after printing 100,000 sheets. The carbon content was measured using a EMIA-8100 analyzer (available from Horiba).

TABLE 1

| | Amount of Wax (J/g) | Carbon (wt %) | Amount of charges (Q/M, −μC/g) |
|---|---|---|---|
| Initial magnetic carrier | 0.2275 | 0.2827 | 35 |
| Magnetic carrier after printing 100,000 sheets using a two-component toner A including wax having ΔH of about 0.9 | 0.2094 | 0.7295 | 32 |
| Magnetic carrier after printing 100,000 sheets using a two-component toner B including wax having ΔH of about 2.0 | 0.2347 | 3.3899 | 20 |

Referring to Table 1, the carbon content in the surface of an initial magnetic carrier was about 0.28%. However, there was a large difference in carbon content in the surface of the magnetic carrier after the printing of 100,000 sheets, depending on the amount of wax in the toner. After the printing of 100,000 sheets, the carbon content in the surface of the magnetic carrier was increased to about 0.73% when the heat of melting (ΔH) was about 0.9, and to about 3.39% when the heat of melting (ΔH) was about 2.0.

This is attributed to migration of the wax on the toner surface to the surface of the magnetic carrier by friction between the surface of the magnetic carrier and toner particles. Due to the increased carbon content in the surface of the magnetic carrier, the amount of charges was reduced from −35 μC/g, an initial level before printing, to about −32 μC/g in the two-component toner A having a heat of melting (ΔH) of about 0.9, and to about −20 μC/g in the two-component toner B having ΔH of about 2.0. Therefore, it is found that contamination of the magnetic carrier surface by the carbon component originating from the wax is one of main causes of the charge amount reduction in the toner.

The core particles may be prepared using, for example, pulverization, agglomeration, or spraying. For example, pulverization may involve melt-mixing a binder resin, a colorant, and a releasing agent, and pulverizing the mixture. For example, agglomeration may involve mixing a binder resin dispersion, a colorant dispersion, and a releasing agent dispersion, agglomerating particles in the mixture to obtain agglomerates, and unifying the agglomerates. The core particles may further include a charge control agent.

For example, the core particles may have a volume average particle size of about 4 μm to about 20 μm, and in some embodiments, from about 5 μm to about 10 μm. However, embodiments are not limited thereto.

A shape of the core particles is not specifically limited. The more spherical the shape of the core particles is, the greater the charge stability and the dot reproducibility of printed images the toner may have. For example, the core particles may have a sphericity of about 0.90 to about 0.99.

The core particles may include an external additive adhering to an external surface of the core particles. One of the main functions of the external additive is to prevent toner particles from sticking to each other and thus maintain fluidity of the toner powder. The inventors of the present invention also focused on the behavior of external additive as a cause of the charge amount change in the toner. Due to friction between the toner particles and the magnetic carrier caused from stirring for a long time, the external additive on the surface of the toner particles is more likely buried into the toner particles. Furthermore, the external additive on the surface of the toner particles is more likely separated from the toner particles by friction and shear force. The separated external additive may adhere to the surface of the magnetic carrier and prevent maintaining of the initial charge amount.

Figure 3:
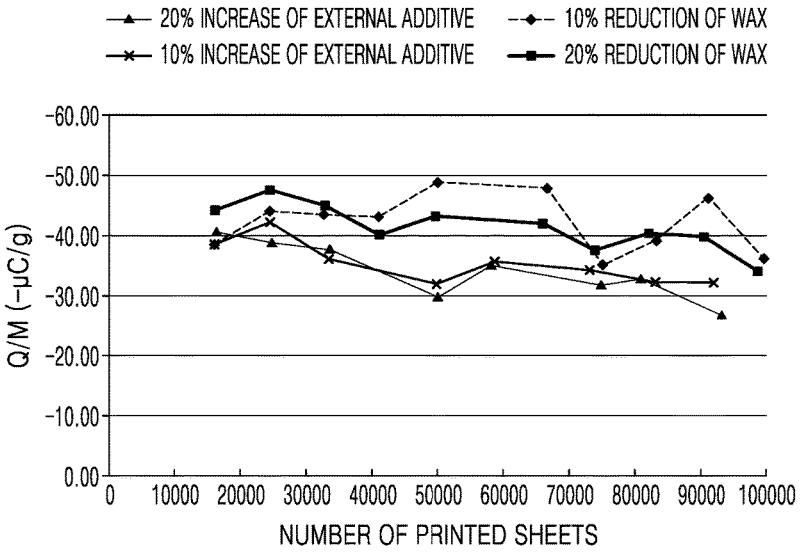
FIG. 3 is a graph illustrating change in charge amount when the amount of an external additive is increased or the amount of wax is reduced with respect to those in a reference toner.

In this regard, the inventors of the present invention measured changes in charge amount in toners prepared by increasing the amount of the external additive or reducing the amount of wax with respect to those in a reference toner. The results are shown in FIG. 3. Referring to FIG. 3, when the amount of the external additive is increased with respect to that of the reference toner, for example, when the amount of titanium oxide having an average particle diameter of about 40 nm is increased by about 10% or the amount of silica having an average particle diameter of about 12 nm is increased by about 20%, charge amount reduction with respect to the initial charge amount became severe as the number of printed sheets increased. On the other hand, when the amount of a carnauva wax having a melting temperature of about 70° C. is reduced by about 10% or 20% with respect to that of the reference toner, the initial charge amount advantageously tended to be maintained even with an increasing number of printed sheets.

Based on the above-described basic research, the inventors of the present invention found that controlling the intensities of silicon, titanium, and iron, i.e., [Si], [Ti], and [Fe], measured by X-ray fluorescence spectrometry, to satisfy the following conditions may be advantageous in improving charge uniformity, charge stability, and transferability of the toner:

$$0.005 \leq [Si] \leq 0.2 \quad (8)$$

$$1 \leq [Ti] \leq 30 \quad (9)$$

$$2 \leq [Fe] \leq 200 \quad (10)$$

The inventors of the present invention also found that controlling the external additive to satisfy the following conditions of the intensities of silicon [Si], titanium [Ti], and iron [Fe], measured by X-ray fluorescence spectrometry, may be more advantageous in improving charge uniformity, charge stability, and transferability of the toner:

$$0.005 \leq [Si] \leq 0.15$$

$$1 \leq [Ti] \leq 30$$

$$2 \leq [Fe] \leq 150$$

In some embodiments, the core particles may include an external additive on the surface thereof, the external additive including silica particles, titanium oxide particles, and iron oxide particles.

The silica particles may include, for example, fumed silica, sol-gel silica, or a mixture thereof. Fumed silica particles in most wide use have strong negative polarity. Accordingly, excess charge-up may frequently occur with the use of toner that includes fumed silica as an external additive. When the silica particles have a primary particle size that is too large, it may be relatively difficult for the externally added toner particles to pass through a developing blade, and consequently, a toner selection phenomenon may occur. That is, with prolonged use of a toner cartridge, the size of toner particles remaining in the toner cartridge may gradually increase. Consequentially, a charge amount of the toner may be reduced, and a toner layer developing the electrostatic latent image may have an increased thickness. When the silica particles have a primary particle size that is too large, the silica particles may be exposed to stress caused by a member, such as a feed roller, and thus may more likely be separated from the core particles and may contaminate a charging member or a latent image carrier. On the other hand, when the silica particles have a particle size that is too small, due to a shearing stress which a developing blade may exert on the toner particles, the silica particles may become buried into the core particles. This may cause the silica particles to lose the function as an external additive, disadvantageously leading to increased adhesion between the toner particles and a surface of a photoreceptor, and consequently may result in deterioration in toner cleaning properties and toner transferability. For example, the silica particles may have a volume average primary particle size of about 5 nm to about 80 nm, and in some embodiments, about 30 nm to about 80 nm, and in some other embodiments, about 60 nm to about 80 nm.

The iron oxide particles may improve the charge distribution and charge uniformity of the toner, and prevent an excess charge-up of silica particles. Iron oxide may prevent an excess charge-up of the toner due to iron oxide's having a relatively small electric resistance compared to silica, and simultaneously improve development characteristics and transferability of the toner due to iron oxide's having a relatively large particle size. For example, the iron oxide particles may have a volume average primary particle size of about 50 nm to about 300 nm, and in some embodiments, about 80 nm to about 300 nm, and in some other embodiments, about 80 nm to about 200 nm, and in still other embodiments, about 80 nm to about 150 nm.

The titanium oxide particles may have a relatively small resistance and prevent excess frictional charging caused from an excess charge-up caused by silica particles. Titanium oxide may prevent an excess charge-up of the toner due to having a relatively small electric resistance compared to silica, and simultaneously improve development characteristics and transferability of the toner due to titanium oxide's having a relatively large particle size. For example, the titanium oxide particles may have a volume average primary particle size of about 10 nm to about 100 nm, and in some embodiments, about 20 nm to about 60 nm.

In some embodiments, the external additive of the toner may include iron oxide particles having a volume average primary particle size of about 80 nm to about 300 nm, small-diameter silica particles having a volume average primary particle size of about 5 nm to about 50 nm, and titanium oxide particles having a volume average primary particle size of about 20 nm to about 60 nm. The small-diameter silica particles may provide an increased surface area and further improve the charge stability of the toner particles. Since the small-diameter silica particles are adhered to the core particles while being dispersed between the iron oxide particles and the titanium oxide particles, the small-diameter silica particles may not be exposed to an external shear force applied to the toner particles. That is, the external shear force may be exerted mainly on the large-diameter iron oxide and titanium oxide particles of the toner particles. This may prevent the small-diameter silica particles from becoming buried into the core particles, thereby maintaining the improved charge stability.

The silica particles may be porous. The silica particles may have hydrophilic surfaces. When a toner including highly porous, highly hydrophilic silica particles as an external additive is used in a high-temperature, high-humidity environment, the toner may not be effectively charged due to the absorption of excess water that serves as an electric conductor. On the other hand, toner including silica particles as an external additive tends to be excessively charged in a low-temperature, low-humidity environment. That is, toners including silica particles as an external additive may have poor charge stability depending on environment conditions. To address such a reduction in environmental charge stability caused by moisture, silica particles may be treated hydrophobically with, for example, hydrophobic silicone oil, hydrophobic silane coupling agent, siloxanes, or silazanes. The titanium oxide and iron oxide particles may also be hydrophobically treated. However, using external additive particles surface-treated with such a surface treatment agent may enhance cohesiveness of the toner particles, and may instead sharply reduce fluidity of the toner particles. In this regard, the silica particles may have a degree of hydrophobicity of about 10 to about 90, for example, about 40 to about 90.

In some embodiments, to prevent separation of the external additive(s) from the core particles by, for example, stress and a shear force in a developing unit, and contamination of the magnetic carrier by the external additive, the amount of the external additive(s) may be as follows: about 0.1 part by weight to about 3 parts by weight of silica, about 0.1 part by weight to about 0.5 parts by weight of iron oxide, and about 0.1 part by weight to about 1.5 parts by weight of titanium oxide, each based on 100 parts by weight of the binder resin in the core particle.

The intensities of silicon [Si], titanium [Ti], and iron [Fe] as indices of the amounts of silicon, titanium, and iron, respectively, in the toner, such as, for example, a two-component non-magnetic toner, mainly originate from silica, titanium oxide, and iron oxide used as the external additive(s). Accordingly, the intensities of silicon [Si], titanium [Ti], and iron [Fe] may be appropriately selected by control of the added amounts of silica, titanium oxide, and iron oxide as the external additive(s). In this regard, based on the above-described basic research, the inventors of the present invention found that controlling the intensities of silicon [Si], titanium [Ti], and iron [Fe], measured by X-ray fluorescence spectrometry, to satisfy the following conditions may be advantageous in improving charge uniformity, charge stability, and transferability of the toner:

$$0.005 \leq [Si] \leq 0.2 \quad (8)$$

$$1 \leq [Ti] \leq 30 \quad (9)$$

$$2 \leq [Fe] \leq 200 \quad (10)$$

The inventors of the present invention also found that controlling the external additive to satisfy the following conditions of the intensities of silicon [Si], titanium [Ti], and iron [Fe], measured by X-ray fluorescence spectrometry, may improve all the charge uniformity, charge stability, and transferability of the toner:

$$0.005 \leq [Si] \leq 0.15$$

$$1 \leq [Ti] \leq 30$$

$$2 \leq [Fe] \leq 150$$

As described above, according to one or more embodiments, to prevent separation of the external additive(s) from the core particles by, for example, stress and a shear force in a developing unit, and contamination of the magnetic carrier by the external additive, the amounts of silica particles, titanium oxide particles, and iron oxide particles may be controlled. That is, the iron oxide particles having a relatively large particle diameter may suppress the silica particles from becoming buried into the core particles or being separated from the core particles. Accordingly, the amount of the external additive moving to the surface of the magnetic carrier may be reduced. To improve charge uniformity and suppress an excess charge-up of silica particles, a combination of iron oxide particles and titanium oxide particles may be further added. The iron oxide and titanium oxide particles may suppress an excess charge-up of the toner due to their having a relatively low resistance compared to silica particles and may improve development characteristics and transferability of the toner due to their having a relatively large particle size.

In some embodiments, the toner may be prepared by attaching the external additive particles to the surface of the core particle(s). The attaching of the external additive particles to the surface of the core particles may be performed using, for example, a powder mixing apparatus. Non-limiting examples of the powder mixing apparatus may include a Henshell mixer, a V-shape mixer, a ball mill, and a nauta mixer.

When a toner according to any of the embodiments is used as a two-component developer, the toner may further include a magnetic carrier. That is, a two-component developer according to an embodiment may be a mixture of the above-described toner particles and a magnetic carrier. For example, the amount of the toner particles in the two-component developer may be about 1 to 20 wt %, and in some embodiments, about 5 to 20 wt %, based on a weight of the two-component developer. When the amount of the toner particles is less than 1 wt %, the amount of charges may be too high. When the amount of the toner particles exceeds 20 wt %, scattering of the toner may more likely occur.

In some embodiments, the magnetic carrier of the toner may be a "magnetic particle dispersion resin carrier" wherein a magnetic particle is coated with a resin. The magnetic particle dispersion resin carrier may be prepared using any known method. For example, a binder resin and magnetic particles, and optionally an additive such as carbon black, a charge control agent, and inorganic particles if needed, may be mixed together to obtain a mixture. After melt-compounding the mixture, rough grinding and fine grinding may be performed, followed by sorting to obtain a magnetic particle dispersion resin carrier having a desired average particle diameter.

The magnetic particle dispersion resin carrier obtained as described above may have a weight average particle diameter of about 15 to about 60 microns, for example, about 20 to about 50 microns. When the magnetic particle dispersion resin carrier has a weight average particle diameter of less than 15 microns, the magnetic particle dispersion resin carrier may more likely adhere to a photoreceptor. When the magnetic particle dispersion resin carrier has a weight average particle diameter of greater than 60 microns, it may be difficult to obtain high-quality images.

Magnetic particles in a core part of the magnetic particle dispersion resin carrier may include, for example, iron oxide, magnetite, and/or ferrite. For example, the magnetic particles in the core part may be ferrite particles, for example, manganese-containing ferrite particles, which may provide improved balance between charging characteristics and electric resistance.

Examples of resin coating the magnetic particles in the magnetic particle dispersion resin carrier may include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride/acetic acid vinyl copolymer, a styrene/acryl copolymer, fluorine resin, silicon resin, acryl resin, polycarbonate, phenol resin, amino resin, melamine resin, urea resin, amide resin, and epoxy resin. For example, silicon resin, fluorine resin, and acryl resin of these resins may provide improved charge stability and coating characteristics. That is, in some embodiments, the magnetic particle dispersion resin carrier in the toner may include ferrite as a core material, and be coated with at least one resin selected from silicon resin, fluorine resin, and acryl resin. For example, the magnetic particle dispersion resin carrier may be coated with silicon resin, since silicon resin may inhibit adhering of toner particles to the surface of the magnetic particle dispersion resin carrier. In some embodiments, after the coating of the resin, the resulting coating layer may be subjected to a cross-linking reaction to control the strength or charge amount of the coating layer. The entire surface of the magnetic particles may be completely uniformly coated with such a coating resin. In some embodiments, the magnetic particles may be spot-coated to be partially exposed. For example, a conductivity controller, carbon black, a quaternary ammonium salt, and/or a catalyst may be added to the coating resin.

In some embodiments, in the two-component developer, an average particle diameter D50t of the toner particles and an average particle diameter D50c of the magnetic carrier particles may satisfy the following condition:

$$0.08 \leq D50t/D50c \leq 0.25 \quad (7)$$

The average particle diameter D50t refers to an average particle diameter of the toner particles at 50% by cumulative weight of a cumulative particle diameter distribution curve of the toner particles, and the average particle diameter D50c of the magnetic carrier particles refers to an average particle diameter of the magnetic carrier particles at 50% by cumulative weight of a cumulative particle diameter distribution of the magnetic carrier particles.

In some other embodiments, in the two-component developer, an average particle diameter D50t of the toner particles and an average particle diameter D50c of the magnetic carrier particles may satisfy the following condition:

$$0.08 \leq D50t/D50c \leq 0.20$$

When a ratio of D50t to D50c (D50t/D50c) is less than 0.08, the particle diameter of the magnetic carrier may be so relatively large to lower admixing property of the developer, thereby deteriorating charging characteristics of the toner, and consequentially development characteristics/transferability of the toner. On the other hand, when the ratio of D50t/D50c exceeds 0.25, the particle diameter of the magnetic carrier may be so small that the magnetic carrier may be more likely to be developed onto the photoreceptor. Therefore, to obtain an appropriate admixing property between the toner particles and the magnetic carriers and to prevent the development of the magnetic carrier, the ratio of D50t/D50c may be within the above ranges.

One or more embodiments of the present disclosure will now be described in detail with reference to the following examples. However, these examples are only for illustrative purposes and are not intended to limit the scope of the one or more embodiments of the present disclosure.

Example 1

(1) Preparation of Toner Particles 60 parts by weight of high-molecular weight polyester resin H (hereinafter, referred to as "resin H", Samyang Chemical Industries Co., Ltd, 8035TR), 40 parts by weight of low-molecular weight polyester resin L (hereinafter, referred to as "resin L", Samyang Chemical Industries Co., Ltd, 8025TR), 1.5 parts by weight of carnauba wax having a melting point of about 72° C. (hereinafter, referred to as "wax A", Katoyoko, # No. 1), 2 parts by weight of fatty acid ester wax having a melting point of about 83° C. (hereinafter, referred to as "wax B"), 2 parts by weight of a charge control agent (available from Hodogaya, T77), and 5 parts by weight of carbon black (available from Cabot Corporation, Mogul-L) were pre-mixed together using a Henschel Mixer (available from Misui Mining, FM20C/1). The resulting pre-mixture was fed to a hopper of a twin extruder (available from Ikegai, PCM 30) and subjected to melting and kneading. The melt-kneaded product was continuously cooled while it was discharged through nozzles, and then roughly grinded using a hammer mill. This rough grinded product was then finely grinded using a jet mill (available from Hosokawa, TSG). This fine grinded product was sorted using a sorter (available from Hosokawa, TTSP) to obtain core particles having a volume average particle diameter of about 8 μm.

To add an external additive to the surface of the core particles, the amounts of hydrophobic silica particles, titanium oxide particles, and iron oxide particles in nanosize, as represented in Table 2, each based on 100 parts by weight of the core particles, were mixed together using a mixer (available from DAE WHA Tech Co., Ltd, KMLS2K) and stirred to obtain toner particles including the external additive adhering to the surface of the core particles. The stirring was performed at about 2000 rpm for about 30 seconds and at about 6000 rpm for about 3 minutes.

TABLE 2

| | Product name | Average particle diameter (nm) | Manufacturer | Amount (parts by weight) |
|---|---|---|---|---|
| Hydrophobic silica Particle | RX200 | About 15 | Nippon Aerosil Co., LTD. | 1 |
| Titanium oxide particle | STT30S | About 40 | Titan Kokyo Co. LTD | 0.5 |
| Iron oxide particle | SMT-02H | About 100 | Cosmo AM&T | 0.1 |

Figure 4:
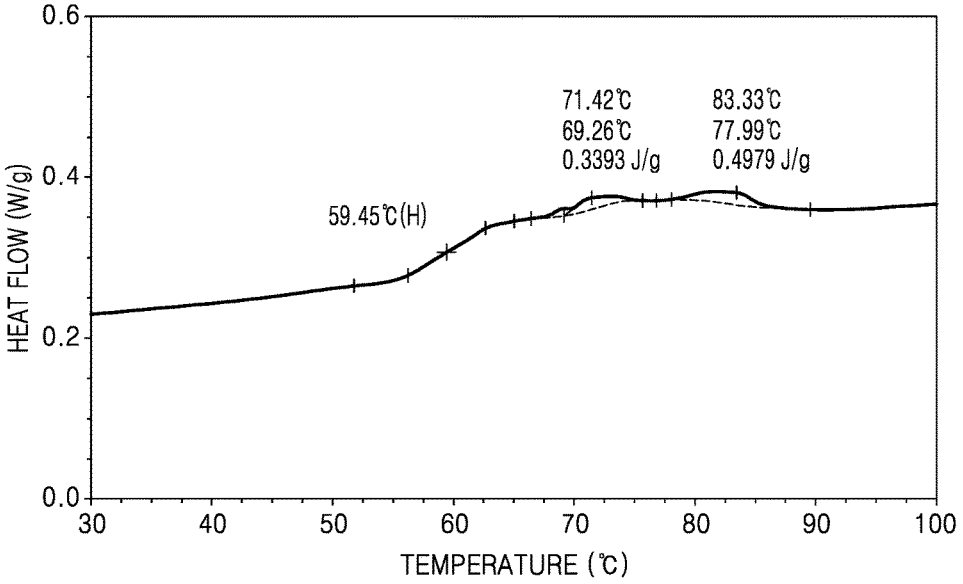
FIG. 4 is a DSC endothermic thermograph of the externally added toner particles obtained in Example 1.

FIG. 4 is a DSC endothermic thermograph of the toner particles of Example 1 including the external additive. The toner particles of Example 1 had a Tg of about 59° C., a Tm1 of about 71° C., a Tm2 of about 83° C., a ΔH1 of about 0.339 J/g, and a ΔH2 of about 0.498 J/g.

(2) Preparation of Magnetic Carrier 1 part by weight of carbon black (available from Cabot Corporation, Mogul-L) and 10 parts by weight of silicon resin were dissolved in 100 parts by weight of toluene to prepare a coating resin composition. This coating resin composition was added to 100 parts by weight of ferrite particles in a weight ratio of the coating resin to ferrite particles of about 2:10 and then mixed to coat the surface of the ferrite particles with the coating resin composition.

The coated ferrite particles were sufficiently dried and then treated at about 250° C. for about 3 hours. 100 parts by weight of the obtained resin-coated ferrite and 250 parts by weight of zirconia beads having a diameter of about 2 mm were put into a polyethylene bottle and then ball-milled at about 100 rpm for about 3 hours to obtain a magnetic carrier.

(3) Preparation of Developer 10 parts by weight of the toner particles and 90 parts by weight of the magnetic carrier were mixed to thereby prepare a two-component developer.

Examples 2 to 7

Two-component developers were prepared in the same manner as described in Example 1, except that the added amounts of the wax A, wax B, and external additives were varied as summarized in Table 3.

Comparative Examples 1 to 4

Two-component developers were prepared in the same manner as described in Example 1, except that at least one of wax A and wax B were replaced with at least one of wax C and wax D as indicated in Table 3. The wax C was polypropylene wax (Viscol 550P, available from Sanyo Chemical Industries Co., Ltd), and the wax D was paraffin wax (Paraffin Wax standard 155, available from Nippon Seiro Co., Ltd.).

Comparative Examples 5 to 14

Two-component developers were prepared in the same manner as described in Example 1, except that the added amounts of the wax A, wax B, and external additives were varied as in Table 3.

The compositions of the two-component developers of Examples 1 to 7 and Comparative Examples 1 to 16, including the binder resin, releasing agent, and external additives, are summarized in Table 3.

TABLE 3

| Example | Resin H | Resin L | Wax A | Wax B | Wax C | Wax D | Silica | Titanium oxide | Iron oxide |
|---|---|---|---|---|---|---|---|---|---|
| E1 | 6 | 4 | 1.5 | 2 | | | 1 | 0.5 | 0.1 |
| E2 | 6 | 4 | 0.5 | 1 | | | 1.5 | 0.5 | 0.1 |
| E3 | 6 | 4 | 2 | 2 | | | 1 | 1 | 0.1 |
| E4 | 6 | 4 | 2.5 | 2 | | | 1 | 0.5 | 0.15 |
| E5 | 6 | 4 | 1.5 | 2 | | | 1 | 0.5 | 0.15 |
| E6 | 6 | 4 | 2 | 1.8 | | | 1 | 0.5 | 0.1 |
| E7 | 6 | 4 | 1.5 | 2 | | | 5 | 0.5 | 0.1 |
| CE1 | 6 | 4 | 1.5 | | 2 | | 1 | 0.5 | 0.1 |
| CE2 | 6 | 4 | 1.5 | | | 2 | 1 | 0.5 | 0.1 |
| CE3 | 6 | 4 | | 1.5 | | 2 | 1 | 0.5 | 0.1 |
| CE4 | 6 | 4 | | | 1.5 | 2 | 1 | 0.5 | 0.1 |
| CE5 | 6 | 4 | 1.5 | 2.5 | | | 1 | 0.5 | 0.1 |
| CE6 | 6 | 4 | 3 | 2 | | | 1 | 0.5 | 0.1 |
| CE7 | 6 | 4 | 2 | 3 | | | 1 | 0.5 | 0.1 |
| CE8 | 6 | 4 | 2 | 1.5 | | | 1 | 0.5 | 0.1 |
| CE9 | 6 | 4 | 1.5 | 2 | | | 1 | 0.5 | 0.1 |
| CE10 | 6 | 4 | 2 | 2 | | | 1 | 0.5 | 0.1 |
| CE11 | 6 | 4 | 1.5 | 2 | | | 0.1 | 0.5 | 0.1 |
| CE12 | 6 | 4 | 1.5 | 2 | | | 6 | 0.5 | 0.1 |
| CE13 | 6 | 4 | 1.5 | 2 | | | 1 | 1.5 | 0.1 |
| CE14 | 6 | 4 | 1.5 | 2 | | | 1 | 1 | 0.1 |
| CE15 | 6 | 4 | 1.5 | 2 | | | 1 | 1 | 0.2 |
| CE16 | 6 | 4 | 1.5 | 2 | | | 1 | 1 | 0.01 |

*E and CE are the acronyms of "Example" and "Comparative Example", respectively.
**All numerical values are in units of parts by weight.

Physical characteristics of the two-component developers of Examples 1 to 7 and Comparative Examples 1 to 16 are summarized in Table 4.

TABLE 4

| | Tg* | Tm1 | Tm2 | ΔH1** | ΔH2 | ΔH1/ΔH2 | D50t/D50c | [Si]*** | [Ti] | [Fe] | Fixing characteristics | Fluidity | Charge stability | Development characteristic | Photoreceptor background contamination |
|---|---|---|---|---|---|---|---|---|---|---|---|---|---|---|---|
| E1 | 59 | 71 | 83 | 0.339 | 0.498 | 0.681 | 0.200 | 0.030 | 15 | 70 | ◎ | ◎ | ◎ | ◎ | ◎ |
| E2 | 59 | 72 | 84 | 0.125 | 0.225 | 0.556 | 0.160 | 0.070 | 18 | 80 | ◎ | ◎ | ◎ | ◎ | ◎ |
| E3 | 62 | 71 | 85 | 0.456 | 0.498 | 0.916 | 0.180 | 0.025 | 28 | 88 | ◎ | ◎ | ◎ | ◎ | ◎ |
| E4 | 56 | 68 | 82 | 0.652 | 0.559 | 1.166 | 0.160 | 0.033 | 15 | 120 | ◎ | ◎ | ◎ | ◎ | ◎ |
| E5 | 61 | 71 | 87 | 0.350 | 0.560 | 0.625 | 0.170 | 0.034 | 16 | 100 | ◎ | ◎ | ◎ | ◎ | ◎ |
| E6 | 59 | 74 | 83 | 0.526 | 0.456 | 1.154 | 0.180 | 0.028 | 14 | 50 | ◎ | ◎ | ◎ | ◎ | ◎ |
| E7 | 60 | 73 | 85 | 0.388 | 0.521 | 0.745 | 0.170 | 0.150 | 15 | 90 | ◎ | ◎ | ◎ | ◎ | ◎ |
| CE1 | 58 | 72 | 95 | 0.340 | 0.450 | 0.756 | 0.190 | 0.030 | 15 | 72 | X | ○ | ○ | ◎ | ◎ |
| CE2 | 59 | 72 | 104 | 0.550 | 0.510 | 1.078 | 0.150 | 0.028 | 14 | 71 | X | ○ | Δ | ◎ | ○ |
| CE3 | 61 | 86 | 104 | 0.350 | 0.498 | 0.703 | 0.160 | 0.023 | 14 | 72 | X | ○ | Δ | ◎ | ○ |
| CE4 | 60 | 95 | 105 | 0.430 | 0.521 | 0.825 | 0.180 | 0.031 | 16 | 71 | X | ○ | Δ | ◎ | ○ |
| CE5 | 61 | 72 | 84 | 0.321 | 0.691 | 0.465 | 0.190 | 0.029 | 15 | 70 | X | ◎ | ○ | ◎ | ◎ |
| CE6 | 62 | 73 | 84 | 0.950 | 0.561 | 1.693 | 0.200 | 0.024 | 16 | 71 | ○ | ○ | X | ◎ | ◎ |
| CE7 | 61 | 74 | 83 | 0.559 | 0.950 | 0.589 | 0.200 | 0.028 | 15 | 72 | ○ | Δ | X | ◎ | ◎ |
| CE8 | 57 | 73 | 84 | 0.498 | 0.331 | 1.505 | 0.180 | 0.024 | 16 | 70 | ○ | Δ | X | ○ | ○ |
| CE9 | 62 | 71 | 85 | 0.339 | 0.498 | 0.681 | 0.220 | 0.030 | 14 | 70 | ◎ | ○ | ◎ | ◎ | X |
| CE10 | 58 | 70 | 83 | 0.456 | 0.498 | 0.916 | 0.075 | 0.028 | 14 | 72 | ◎ | ◎ | ○ | X | Δ |
| CE11 | 57 | 73 | 82 | 0.456 | 0.498 | 0.916 | 0.170 | 0.003 | 15 | 60 | ◎ | X | Δ | X | X |
| CE12 | 61 | 74 | 83 | 0.652 | 0.559 | 1.166 | 0.190 | 0.160 | 15 | 72 | X | ◎ | X | X | ○ |
| CE13 | 62 | 72 | 85 | 0.350 | 0.560 | 0.625 | 0.180 | 0.032 | 35 | 70 | X | ◎ | X | ○ | X |
| CE14 | 58 | 74 | 85 | 0.526 | 0.456 | 1.154 | 0.160 | 0.032 | 0 | 95 | ◎ | ○ | ○ | X | ○ |
| CE15 | 61 | 69 | 83 | 0.388 | 0.521 | 0.745 | 0.2 | 0.016 | 15 | 152 | ◎ | X | X | X | Δ |
| CE16 | 59 | 70 | 83 | 0.652 | 0.559 | 1.166 | 0.198 | 0.028 | 21 | 15 | ◎ | ○ | ○ | Δ | X |

*The units of Tm1, Tm2, and Tg are ° C.
**The units of ΔH1 and ΔH2 are J/g.
***The units of the intensities of silicon [Si], titanium [Ti], and iron [Fe] are cps/μA.

The characteristics of the two-component developers of Examples 1 to 7 and Comparative Examples 1 to 16 in Table 4 were evaluated using the following evaluation methods.

<Evaluation Methods>

The following tests were performed to evaluate the characteristics of the two-component developers of the examples and comparative examples.

<Measurement of Melting Temperature (Tm), Heat of Melting (ΔH), and Glass Transition Temperature (Tg)>

A DSC thermogram of 6~7 mg of each toner sample in powder form was obtained in a nitrogen atmosphere using a DSC Q2000 (available from TA Instruments) under the following heat profile conditions.

$1^{st}$ heating: Heating from 0° C. to 140° C. at a rate of 20° C./min, and then, the temperature being maintained at 140° C. for 1 minute Cooling: Cooling from 140° C. to 0° C. at a rate of −10° C./min, and then the temperature being maintained at 0° C. for 1 minute $2^{nd}$ heating: Heating from 0° C. to 140° C. at a rate of 10° C./min.

A melting temperature (unit: ° C.) of each wax was determined based on the vertex of an endothermic peak resulting from crystal melting in the DSC thermogram of each of the toners. The first and second heats of melting (ΔH1) and (ΔH2) (unit: J/g) were calculated as the areas of the endothermic peaks. A glass transition temperature (Tg) (unit: ° C.) was determined as the midpoint of a linear region of a stepped endothermic curve (so-called baseline shift) resulting from glass transition in the DSC curve.

<Measurement of D50t/D50c Ratio>

A toner particle size distribution was obtained from toner particle diameters measured using a particle sizing and counting analyzer (Multisizer™ III, available from Beckman Coulter, Inc.), and then divided into predetermined particle diameter ranges (channels). With respect to each of the particle diameter ranges (channels), a cumulative volume distribution of the toner particles was plotted, wherein the accumulation was summed up from the smaller particle size to the larger particle size, and a cumulative particle diameter at 50% of the cumulative volume distribution was measured as D50t. An average particle diameter (D50c) of the magnetic carrier particles was measured in the same manner. A D50t/D50c ratio was calculated from the measured D50t and D50c.

<Measurement of [Si]/[Fe] Ratio>

The ratios of intensities of silicon [Si], titanium [Ti], and iron [Fe] in the toners were measured by X-ray fluorescence spectrometry (XRF) as follows.

First, 3 g (±0.01 g) of a toner sample was pressed into a shape by using a press molder under a load of 2t for 10 seconds. The toner sample was analyzed by X-ray fluorescence spectrometry using an energy dispersive X-ray spectrometer (EDX-720, available from SHIMADZU Corporation) to measure the intensities of silicon [Si], titanium [Ti], and iron [Fe] (unit: cps/μA) from the fluorescence X-ray energies generated from the toner sample, as the indices of the amounts of silicon, titanium, and iron in the toner, respectively. The XRF was performed at an X-ray tube voltage of about 50 kV and X-ray tube current of 23 μA.

<Evaluation of Fixing Characteristics>

In a chamber at room temperature (20±2° C.) and a relative humidity of 55±5%, each of the developers of the examples and comparative examples was loaded into a toner cartridge of a two-component development system printer (SCX-6555, available from Samsung Electronics), and then, a developed toner amount of a beta image was controlled to be about 0.70 mg/cm$^2$, and then, a fixed image (2.5 cm×4 cm) was printed on 50 sheets (Product name: 80 g Paper), and the fixing characteristics of the fixed image were evaluated.

After measuring an optical density (OD) of each fixed image, a piece of tape (3M 810 Scotch Tape) was attached to an image region, which was then pressed by reciprocating a weight of 500 g thereon 5-times. After peeling the tape off, an OD of the image region was measured. The fixing characteristic (unit: %) was calculated using the following equation.

$$\text{Fixing characteristic}(\%)=(\text{OD after tape peeling}/\text{OD before tape peeling})\times 100.$$

The fixing characteristic of each toner was evaluated based on an average from the fixed images of the three sheets, according to the following criteria.

◎: 90%≤fixing characteristic

○: 80% fixing characteristic x: fixing characteristics 70%

<Evaluation of Toner Fluidity>

To evaluate fluidity of each toner, cohesiveness (Carr's cohesion) of each toner was measured as follows.

Equipment: Hosokawa micron powder tester PT-S

Amount of sample: 2 g

Amplitude: 1 mm Dial 3~3.5

Sieve size: 53 μm, 45 μm, 38 μm

Vibration time: 120±0.1 sec

After being stored at room temperature (20±2° C.) and a relative humidity of 55±5% for about 2 hours, each toner sample was sieved under the above conditions. The weights of the toner before and after the sieving were measured. The toner cohesiveness was calculated as follows.

1) [Mass of toner powder remaining on 53 μm sieve/2 g]×100

2) [Mass of toner powder remaining on 45 μm sieve/2 g]×100×(3/5)

3) [Mass of toner powder remaining on 38 μm sieve/2 g]×100×(1/5)

Carr's cohesion=(1)+(2)+(3).

The fluidity of each toner was evaluated according to the following criteria, based on the cohesions measured as described above.

◎: Cohesion≤10 (very effective fluidity)

○: 10<Cohesion≤15 (effective fluidity)

Δ: 15<Cohesion≤20 (low fluidity)

x: 20<Cohesion (very low fluidity)

<Evaluation of Charge Stability (Change in Charging Characteristics Over Time)>

In a chamber at room temperature (20±2° C.) and a relative humidity of 55±5%, each of the developers of the examples and comparative examples was loaded into a toner cartridge of a two-component development system printer (SCX-6555, available from Samsung Electronics), and then, a developed toner amount of a beta image was controlled to be about 0.70 mg/cm$^2$, and then, a fixed image was printed on 100,000 sheets (Product name: 80 g Paper). The toner in each toner cartridge was sampled after every 10,000 sheets of printing to measure a charge amount. A degree of change in charging characteristic with an increasing number of printing sheets with respect to the initial charge characteristic was evaluated according to the following criteria.

◎: Measured charge amount was increased by less than 20% with respect to the initial charge amount ○: Measured charge amount was increased by 20% or greater and less than 30% with respect to the initial charge amount Δ: Measured charge amount was increased by 30% or greater and less than 40% with respect to the initial charge amount x: Measured charge amount was increased by 40% or greater with respect to the initial charge amount <Evaluation of Development Characteristics>

In a chamber at room temperature (20±2° C.) and a relative humidity of 55±5%, each of the developers of the examples and comparative examples was loaded into a toner cartridge of a two-component development system printer (SCX-6555, available from Samsung Electronics), and then, a ratio of toner to developer (T/D) was set to 8%, printing was performed while applying a voltage of 450V and 570V to a magnetic roller (Magroller) and a photoreceptor, respectively. A light-exposure potential was fixed at about 100V during the printing.

After printing 1,000 sheets, a toner image was developed in an area of 10 mm×25 mm of the photoreceptor before being transferred onto an intermediate transfer medium from the photoreceptor, the weight of the toner per unit area of the photoreceptor was measured using a filter-equipped suction apparatus, by measuring the weights of the filter before and after being sucked by the filter-equipped suction apparatus.

Development Performance(%)=Weight of Toner Per Unit Area of the photoreceptor/0.42 ($mg/cm^3$)×100(%)

In the above equation, 0.42 $mg/cm^3$ is the weight of toner which corresponds to an optical density of 1.30 measured by a SPECTROEYE.

◎: 100% or greater≤Development performance

○: 90%≤Development performance<100%

Δ: 80%≤Development performance<90% x: 70%≤Development performance<80%

<Evaluation of Photoreceptor Background Contamination>

In a chamber at room temperature (20±2° C.) and a relative humidity of 55±5%, each of the developers of the examples and comparative examples was loaded into a toner cartridge of a two-component development system printer (SCX-6555, available from Samsung Electronics), and then, printing was performed at a 1% coverage. After printing 10 sheets, three spots in the non-image region on the photoreceptor were taped. Optical densities of the three non-image spots were measured using a reflection densitometer (available from ELECTROEYE) and averaged. The measurement results were evaluated according to the following criteria.

◎: optical density<0.03

○: 0.03≤optical density<0.05

Δ: 0.05≤optical density<0.07 x: 0.07≤optical density

Referring to Table 4, the toners of Example 1 to 7 having a glass transition temperature (Tg), first and second melting temperatures (Tm1 and Tm2), and first and second heats of melting (ΔH1 and ΔH2) that satisfy all the conditions (1), (2), (3), and (4) were found to have all of the improved fixing characteristics, fluidity, charge stability, development characteristic, and photoreceptor background contamination characteristics.

However, the two-component developers of Comparative Examples 1 to 8, in which the amount ratio of wax A to wax B was changed from that of Examples 1 to 7, or in which wax C and/or wax D were further added, were found to be considerably deteriorated in fixing characteristic, fluidity, and charge stability characteristics. In particular, the two-component developer of Comparative Example 5 having a ratio of ΔH1/ΔH2 less than 0.5, which does not satisfy condition (4) of the ratio of ΔH1/ΔH2, was found to have markedly reduced fixing characteristics. The two-component developers of Comparative Examples 6 and 8 having a ratio of ΔH1/ΔH2 exceeding 1.5 were found to have markedly low charge stability. It is found from these results that it is important to control condition (4) to be within an appropriate range to obtain good quality toner having improved fixing characteristics and charge stability.

The two-component developer of Comparative Example 9 having a ratio of D50t/D50c greater than 0.2 (D50t/D50c>0.2) was found to cause a severe photoreceptor background contamination because the magnetic carrier has a small particle size, and thus, being developed onto the photoreceptor. The two-component developer of Comparative Example 10 having a ratio of D50t/D50c less than 0.08 (D50t/D50c<0.08) was found to have reduced admixing property between the toner particles and the magnetic carrier, reduced charge stability, and consequentially being heavily deteriorated in the development characteristic and photoreceptor background contamination characteristic. It is found from these results that it is important to control condition (5) to be within an appropriate range to obtain a toner having improved development characteristic and preventing photoreceptor background contamination.

The two-component developer of Comparative Example 11 was found to have reduced fluidity of the toner particles due to the inclusion of a small amount of silica particles as an external additive, and markedly deteriorated development characteristic and serious photoreceptor background contamination. The two-component developer of Comparative Example 12 was found to have good fluidity of the toner particles due to the inclusion of a large amount of silica particles as an external additive, but was found to cause a charge-up and consequentially have deteriorated fixing characteristics, charge stability and development characteristic. Accordingly, the optical density of a printed toner image was reduced with an increasing number of sheets printed.

The two-component developer of Comparative Example 13 was found to lead to a reduced charge amount of toner and contamination of the magnetic carrier, due to the inclusion of an excess of titanium oxide as external additive, and consequentially have deteriorated fixing characteristic and charge stability, and serious photoreceptor background contamination. The two-component developer of Comparative Example 14 was found to have increased charge amount due to not inclusion of titanium oxide as an external additive, and consequentially deteriorated development characteristic and reduced optical density of a resulting printed image.

The two-component developer of Comparative Example 15 was found to have reduced fluidity of toner particles due to the inclusion of an excess of iron oxide as an external additive, and consequentially markedly deteriorated charge stability and development characteristic, and photoreceptor background contamination. The two-component developer of Comparative Example 16 was found to have reduced development characteristic due to inclusion of a small amount of iron oxide, and serious photoreceptor background contamination.

From the above-described results, it is found that a toner for developing electrostatic latent images according to any of the above-described embodiments which satisfies conditions (1), (2), (3), and (4), and optionally further conditions (5) to (10), may effectively suppress surface contamination of a magnetic carrier. Accordingly, a toner according to any of the embodiments may effectively suppress a charge amount reduction even when used in printing for a long time in a two-component development system. When used in a two-component development system, a toner according to any of the embodiments may exhibit improved transfer characteristics even in printing for a long time, and thus effectively suppress contamination of the electrophotographic imaging apparatus, which otherwise is caused by scattering of toner particles which are not adhered to a magnetic roller, and effectively suppress an image defect, such as photoreceptor background contamination, caused by a charge amount reduction of toner.

According to any of the above-described embodiments, a toner for developing electrostatic latent images that may have improved fixing characteristics, fluidity, charge stability, and development characteristic and may effectively suppress photoreceptor background contamination may be obtained.

EXPLANATION OF SYMBOLS

W/g: watts/gram

Q/M: charge/mass

The invention claimed is:

1. A toner for developing electrostatic latent images, comprising:

a plurality of toner particles, each toner particle comprises:

a core particle comprising a binder resin, a colorant, and a releasing agent; and an external additive adhering to a surface of the core particle, and wherein the toner exhibits two endothermic peaks and a stepped endothermic curve in a thermogram which is obtained from a secondary temperature rise in differential scanning calorimetry (DSC), wherein first and second melting temperatures (Tm1 and Tm2) are determined as temperatures at vertices of the two endothermic peaks, respectively, a glass transition temperature (Tg) is determined as a temperature at a midpoint of a linear region of the stepped endothermic curve, and a first heat and a second heat of melting (ΔH1 and ΔH2) are determined as areas of the two endothermic peaks, respectively, and wherein Tm1, Tm2, Tg, ΔH1 and ΔH2 satisfy the following conditions:

$$55^\circ\ \text{C.} \leq Tg \leq 65^\circ\ \text{C.} \quad (1)$$

$$Tg \leq Tm1 \leq 75^\circ\ \text{C.} \quad (2)$$

$$Tm1 \leq Tm2 \leq 90^\circ\ \text{C.} \quad (3)$$

$$0.5 < \Delta H1/\Delta H2 < 1.5 \quad (4).$$

2. The toner of claim 1, wherein the first heat of melting ΔH1 and the second heat of melting ΔH2 satisfy the following conditions:

$$0.1 \leq \Delta H1 \leq 0.9\ \text{J/g} \quad (5)$$

$$0.1 \leq \Delta H2 \leq 0.9\ \text{J/g} \quad (6).$$

3. The toner of claim 1, wherein the toner further comprises magnetic carrier particles, wherein an average particle diameter (D50t) of the plurality of toner particles and an average particle diameter (D50c) of the magnetic carrier particles satisfy the following condition:

$$0.08 \leq D50t/D50c \leq 0.25 \quad (7)$$

wherein the average particle diameter (D50t) refers to a particle diameter at 50% of cumulative weight in a cumulative particle diameter distribution curve of the toner particles, and the average particle diameter (D50c) of the magnetic carrier particles refers to a particle diameter at 50% of cumulative weight in a cumulative particle diameter distribution of the magnetic carrier particles.

4. The toner of claim 1, wherein the external additive comprises a combination of silica particles, titanium oxide particles, and iron oxide particles.

5. The toner of claim 1, wherein [Si], [Ti], and [Fe] as the intensities of silicon, titanium, and iron measured by X-ray fluorescence spectrometry of the toner satisfy the following conditions:

$$0.005 \leq [\text{Si}] \leq 0.2 \quad (8)$$

$$1 \leq [\text{Ti}] \leq 30 \quad (9)$$

$$2 \leq [\text{Fe}] \leq 200 \quad (10).$$

6. The toner of claim 1, wherein the releasing agent is a combination of a carnauba-based wax and a fatty acid ester-based wax.

7. The toner of claim 1, wherein the binder resin is a polyester resin.

8. The toner of claim 1, wherein the toner is used in a non-magnetic two-component development process.

* * * * *